United States Patent [19]

Fletcher et al.

[11] 4,094,259

[45] June 13, 1978

[54] BUTTON ORIENTATING LIFTING MECHANISM

[75] Inventors: Roy W. Fletcher, Riverdale; Robert W. Volkmann, Arlington Heights; Anthony D. Forte, Chicago, all of Ill.

[73] Assignee: Union Special Corporation, Chicago, Ill.

[21] Appl. No.: 792,376

[22] Filed: Apr. 29, 1977

[51] Int. Cl.[2] ..... D05B 3/14

[52] U.S. Cl. ..... 112/110; 112/113

[58] Field of Search ..... 112/113, 110, 106, 104, 112/111, 112, 114; 221/173, 133

[56] References Cited

U.S. PATENT DOCUMENTS

| | | | |
|---|---|---|---|
| 3,670,673 | 6/1972 | Winston et al. | 112/113 |
| 3,960,094 | 6/1976 | Hsiao | 112/113 X |

*Primary Examiner*—H. Hampton Hunter

*Attorney, Agent, or Firm*—John W. Harbst; John A. Schaerli

[57] ABSTRACT

An automatic button feeder is disclosed including a lifting mechanism arranged for facilitating disengagement of the orientating mechanism associated therewith. The lifting mechanism includes a slideably supported member means which is connected to the orientating mechanism of the button feeder by means of a curved leaf spring. An actuator, which is responsive to movement of the button clamp lifting mechanism, moves the slideable member, and thus the orientating mechanism connected thereto, whereby facilitating disengagement of the latter in timed relation to the sewing cycle.

12 Claims, 5 Drawing Figures

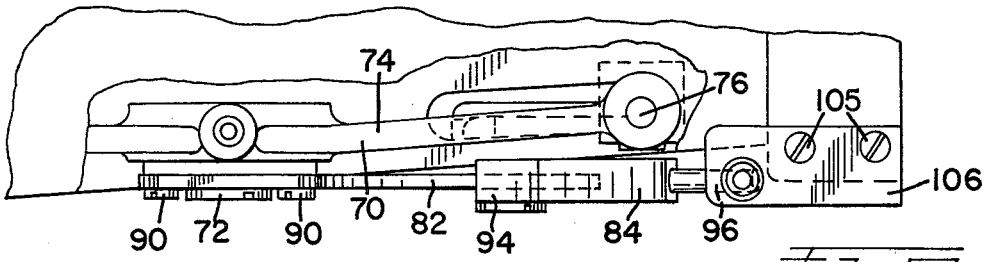
FIG. 4
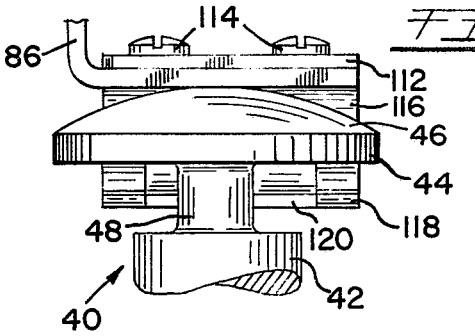
FIG. 5
FIG. 3
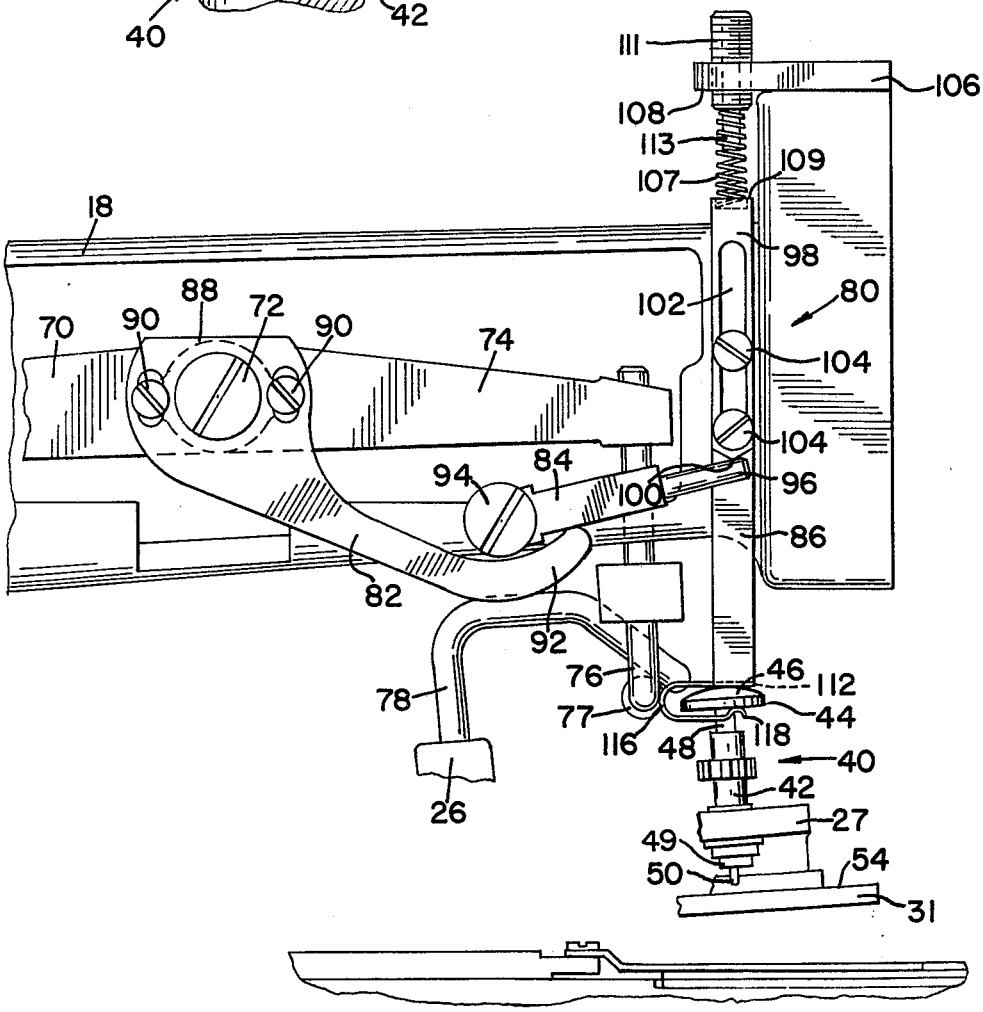

BUTTON ORIENTATING LIFTING MECHANISM

This invention relates in general to button sewing machines and more particularly to a lifting mechanism for use in conjunction with the orientating mechanism associated with an automatic button feeding device.

BACKGROUND OF THE INVENTION

This invention represents an improvement over such apparatus as disclosed in U.S. Pat. No. 3,960,094 issued June 1, 1976 to James C. Hsiao. However, the invention is equally applicable at least in part, to other types of sewing machines having article orientating mechanism means.

In rotational button indexers of the type described in the above identified patent, it is necessary to provide means for engaging and orientating a button prior to the latter being sewn. Upon completion of the sewing cycle the orientating means needs to be removed or disengaged from the button and lifted a sufficient distance from the indexer so as to allow the button turret to rotate the orientated button into the sewing position.

To facilitate disengagement of the orientating means from the button as well as to maintain the orientating means a sufficient distance from the indexer there has been disclosed in the above mentioned patent a flat spring pivotally mounted on the button clamp of the machine. One end of this spring is constrained in a vertical plane while its second end is in engagement with the orientating means. When the clamp is moved to its raised position the end of the spring engaging the orientating mechanism will be forced upward a sufficient distance to disengage the orientating mechanism from the button and securely maintain the orientating mechanism in a raised position away from the button turret. However, an embodiment of this sort has certain drawbacks. One of these drawbacks is that when the button clamp is raised at the end of the sewing cycle it moves with a velocity such that it overthrows its raised position and is forcibly returned slightly downward by a suitable spring mechanism means. The spring back motion of the clamp imparts an identical spring back motion to the leaf spring carried thereby. The spring back motion imparted to the leaf spring causes the orientating means and more particularly the pins depending therefrom to forcibly strike the top of the button turret thus causing damage to same. In order to overcome the spring back problem inherent with the leaf spring design a preload stress was applied to the second end of the spring so as to hold the orientating means in a position removed from the button turret when the clamp was raised. The preload stress placed upon the leaf spring caused further problems in that this stress caused considerable wear and breakage of the leaf spring. The preload stress also caused the orientating means to bear on the bottom of the clamp when the latter was in the raised position. The orientation of the button indexer occurs when the button clamp is in the raised position and the bearing of the orientating means on the underside of the clamp means added frictional stresses to the indexing mechanism.

To maintain the desired result of keeping the orientating means in a position removed from the button indexer, it has also been proposed in the art to use a spring displaced between the button clamp and the orientating means for holding the latter in a proper position upon completion of a sewing cycle. A drawback similar to that inherent with the leaf spring previously discussed results. That is, when the clamp is lifted and is instantly stopped, a resonance in the spring results thus, the pins depending from the orientating mechanism will contact the top of the button turret and after repeated occurances cause considerable wear thereon.

SUMMARY OF THE INVENTION

In accordance with this invention there is provided a positive lifting mechanism operable in timed relation to the sewing cycle for removing the orientating mechanism from the button and then maintaining the pins depending therefrom from the area of the button indexer so as to allow safe rotation of the button indexer. The improved lifting mechanism includes an actuator which is connected to the button clamp lifting mechanism of the machine and is angularly responsive to movements thereof. Approximately aligned with the vertical axis of the orientating means is a member means which is slideably supported on the sewing machine. The member means is connected to the orientating means through a U-shaped leaf spring means which has an opening extending in all vibratory directions of the button clamp. A freely movable coupling is pivotally supported to the sewing machine and has first and second end portion means and a medial portion means connecting same. The first end portion serves to pivotally mount the coupling to the machine while the second end portion is operatively associated with the slideable member. The medial portion of the coupling associates with the actuator and is responsive to movements thereof. A bracket is provided on the top of the sewing machine and a spring is disposed between the bracket and the top of the member means for normally urging the orientating means connected thereto toward the work support. This spring also aids in helping the pins of the orientating mechanism to firmly locate within the holes of the button.

Accordingly, it is one object of the present invention to provide a novel and improved positive lifting mechanism for removing the orientating mechanism from the area of the button indexer.

Another object of this invention is to provide means for lifting the orientating mechanism in timed relation to the sewing cycle.

Yet another object of this invention is to provide a lifting mechanism which is independent of the button clamp assembly means.

In the accompanying drawings annexed hereto and forming part of the specification, the present invention is shown embodied in a three position rotatable button turret associated with a sewing machine, but it will be understood that some of the features of this invention can be embodied in other machines and that the drawings are not to be construed as defining or limiting the scope of the invention, the claims appended to this specification being relied upon for that purpose.

In the drawings:

FIG. 3 is an enlarged partial side view showing the lifting mechanism and the clamp in the raised position.

FIG. 4 is a partial top view of the lifting mechanism as shown in FIG. 3.

FIG. 5 is an enlarged front elevational view showing the lower end of the lifting mechanism as connected to the orientating mechanism.

DETAILED DESCRIPTION OF THE INVENTION

Figure 2:
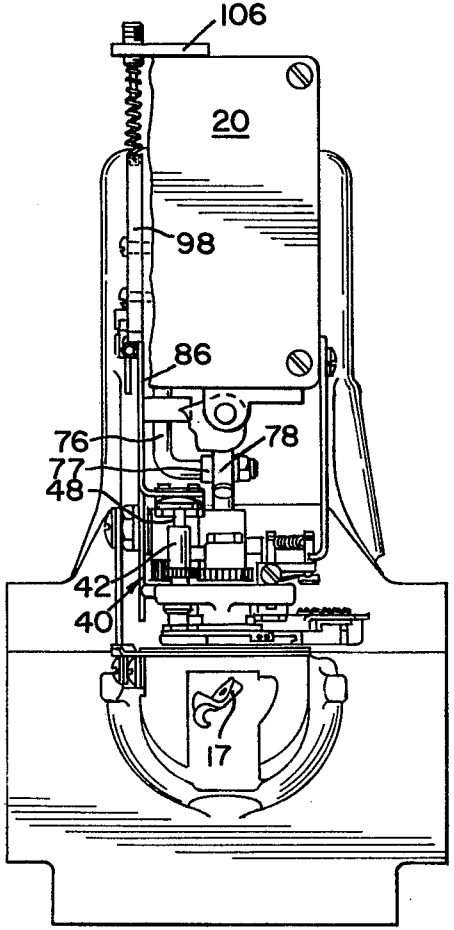
FIG. 2 is a partial front view of FIG. 1.

Before referring to the drawings, it is pointed out that the type of sewing machines for which the improved lifting mechanism was developed are known as automatic or cyclically operated button sewing machines. The sewing machine illustrated in the drawings employs the workings of a button clamp lifting mechanism and stop mechanism of the type disclosed in U.S. Pat. Nos. 2,609,773 to Nelson and granted Sept. 9, 1962 and 3,894,500 to Hsiao and granted July 15, 1975, respectively. As mentioned above, the automatic button positioning apparatus and mechanism for effectively operating same is disclosed in U.S. Pat. No. 3,960,094 to Hsiao and granted June 1, 1976. The type of machine shown in the latter patent is an automatic button sewing machine which includes a positionable work clamping means which is moved into clamping engagement with a fabric at the beginning of the sewing cycle and lifted away therefrom after a predetermined number of stitches have been employed to secure the button to the workpiece. Accordingly, the showing of the machine here is greatly simplified and only certain key parts will be specifically referred to inasmuch as reference of specific details, etc., are disclosed in the above identified patents.

Figure 1:
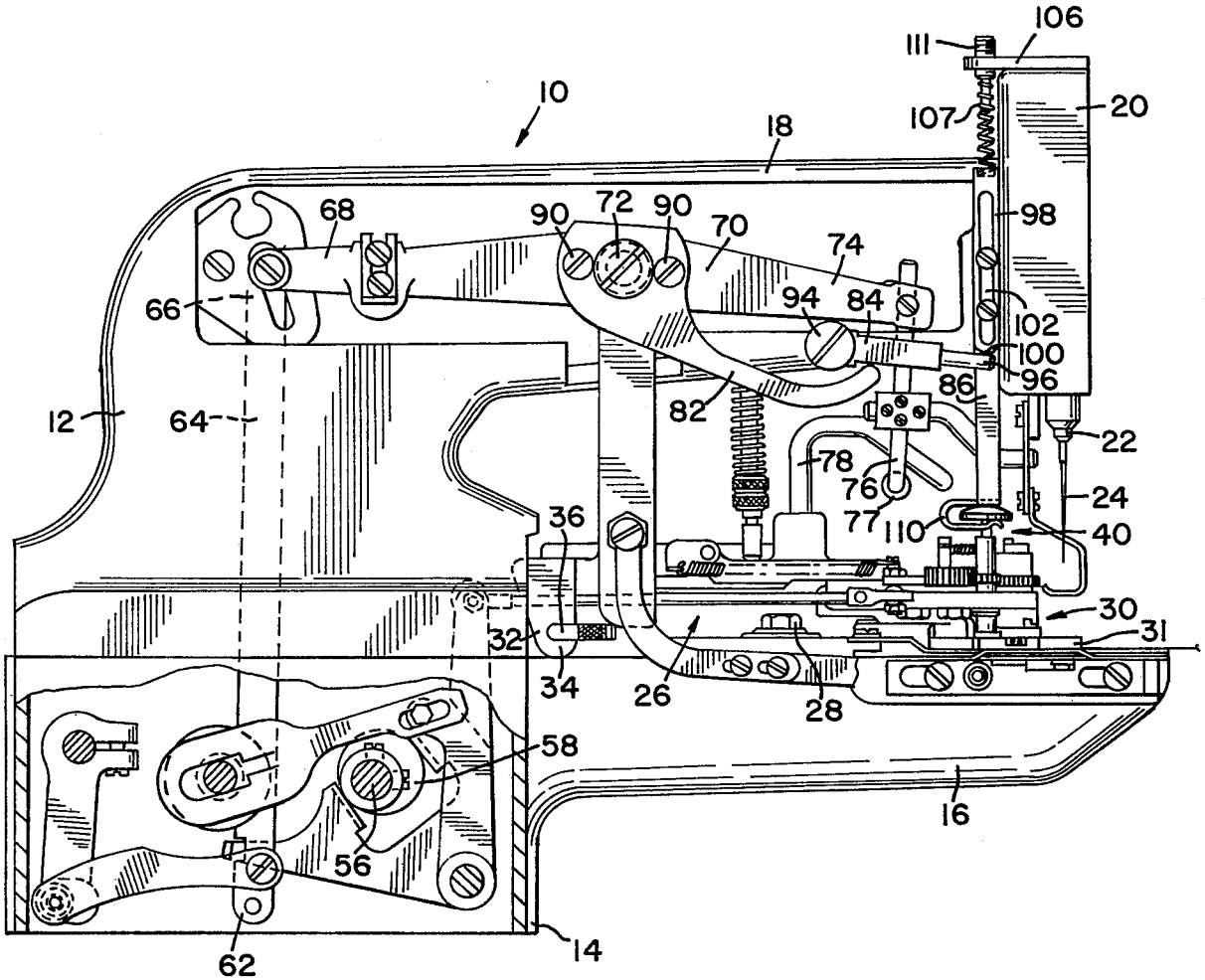
FIG. 1 is a side view of a button sewing machine showing the apparatus of the invention here under consideration slideably secured to the sewing machine arm and showing the button clamp in a fabric engaging position.

Referring now to the drawings and more particularly to FIG. 1 it will be seen that the machine is generally identified by the numeral 10 and includes a vertical standard means 12 having a base portion means 14. Extending horizontally from the base portion means 14 is a work supporting arm means 16 which is adapted to carry a conventional looper means 17 (FIG. 2) and thread cutter means (not shown). Above the arm means 16 and extending horizontally from the upper end of the vertical standard means 12 is an overhanging arm means 18 which has at its outer end a head portion means 20. A needle bar means 22 which carries a needle means 24 is mounted for vertical reciprocatory movement in the head portion means 20. As disclosed in substantial detail in the above identified U.S. patents, a vibratory clamping means 26 is pivoted about a screw means 28. The work supporting and clamping means 26 has secured at its right end means, as viewed in FIG. 1, a button delivery and removal assembly means 30. The work clamping means 26 has at its other end 32 a plurality of depending lug means 34 which are pivotally mounted about a pin means 36 whereby rotational movement in a vertical plane of the clamping means is allowed.

A main shaft means 56 is rotatably mounted in the base portion means 14 and as described in detail in U.S. Pat. No. 3,960,094 the button delivery and removal assembly means 30 is driven therefrom through suitable connections. Inasmuch as these driving means are in no way part of the invention, no attempt has been made to illustrate the same or to further disclose the details thereof here. However, it should be mentioned that the driving means moves the button delivery and removal assembly means 30 through a series of predetermined steps and more particularly indexes a button turret means 31 through a predetermined angle. The predetermined steps are: (1) the buttons are fed and delivered to the button delivery and removal assembly means; (2) the button is orientated to a predetermined position; (3) the button is sewn to the workpiece.

Referring now to FIGS. 2, 3 and 5 the button orientating means 40 will now be discussed. The button orientating means 40 which is shiftable between an operative and inoperative position includes an orientating pin bushing means 42 which is slideably carried by a frame means 27 which is in turn suitably connected to the work supporting and clamping means 26. The bushing means 42 has at its first end means 44 a cap means 46. Immediately below the cap means 46 is a grooved portion means 48 the purpose of which will be described hereinafter. Depending from the second end means 49 of the orientating pin bushing means 42 are a plurality of pin means 50. In operation, pin means 50 when first moved into contacting position with a button will abut against a section of the solid web area between the actual button holes. In order to locate the pin means 50 in the button holes the entire button orientating means 40 is rotated. Once the pin means 50 locate the button holes, gravity and other forces to be discussed hereinafter cause the pin means to drop thereinto and the rotary motion imparted to the button orientating means 40 continues in order to achieve the proper predetermined position of the button.

As mentioned above and as may be best seen in FIGS. 1 and 3 within the base portion means 14 of the machine there is provided a main shaft means 56 which carries an eccentric means 58 that is adapted to rock member means 60 back and forth through a suitable arc upon each revolution of the main shaft means 56. During a stitching cycle of the machine, the rocking of member means 60 is in idle rocking and performs no function. However, just prior to the completion of the stitching cycle the lower end means 62 of link means 64 is shifted into a position such that the lower end means 62 lies in the rocking path of member means 60 which engages link means 64 whereby forcibly causing downward movement of same. The upper end means 66 of link means 64 is pivotally connected to the first end means 68 of a positive button clamp lifting lever means 70 which is pivotally mounted on a stud means 72 in the overhanging arm means 18. The second end means 74 of lever link means 70 carries a downwardly extending rod means 76 the lower end of which extends laterally and carries a roller means 77 (FIG. 2). The roller means 77 is adapted to cooperate with the undersurface of a hook shaped rod means 78 which is suitably secured to the work supporting and clamping means 26. When the link means 64 is driven downwardly, due to the action of member means 60, the button clamp lifting lever means is rotated in a counterclockwise direction about stud means 72 whereby lifting the rod means 76. When the rod means 76 is lifted upwardly it in turn lifts the rod means 78 upwardly, this will rock the clamping means 26 about the axis of pin means 36 and will lift the button delivery and removal assembly means 30, which is fixedly carried on clamping means 26, away from the work. It should be noted at this time, as may be best seen in FIG. 1, that the roller means is in a spaced relationship relative the undersurface of the hook shaped rod means 78 when the clamp means 26 is in the fabric engaging position such that upon initial movement of the button clamp lifting lever means 70 no movement of the work supporting and clamping means 26 will result. The purpose of this will be described hereinafter.

The lifting assembly means generally indicated as 80, is provided for first disengaging the pin means 50 from the button holes upon completion of a sewing cycle and then maintaining the button orientating means 40, and more particularly the pin means 50, in a removed position relative the top surface means 54 of the button turret means 31. As is best seen in FIGS. 3 and 4, the lifting mechanism means 80 includes an actuator means 82, a freely rotatable coupling means 84, and a member means 86 which is connected to the button orientating means 40. The actuator means 82 is secured at its first end means 88, by any suitable means such as 90, to the button clamp lifting lever means 70. In this manner any rotational movement imparted to the lifting lever means 70 will effect a correspondingly angular displacement of the actuator means 82 carried thereby. The second end means 92 of the actuator means 82 associates with the coupling means 84, and forcibly drives the latter during the upstroke of the lifting lever means 70 as will be described hereinafter. The coupling or lever means 84 is pivotally secured at its first end means 94 to the overhanging arm means 18. The second end means 96 of the lever means 84 is operatively engaged with the member means 86 such that movement of the lever means 84 effects the vertical displacement of the member means 86 and thus the button orienting means 40 carried thereby. As may be best noted in FIGS. 2 and 3, the member means 86 is provided with a projecting mounting means 98 which extends along the upper half of the member means 86. The second end means 96 of lever means 84 associates and engages with the lower end 100 of the projecting mounting means 98. In the area of the projecting mounting means 98 the member means 86 is provided with a slot means 102 which has a longitudinal axis perpendicular to the work support means 16 and is in general alignment with the vertical axis of the button orientating means 40. A plurality of bolt means 104 serve to slideably secure the member means 86 to the overhanging arm means 18 while at the same time serve as guide means so that the member means 86 is constrained to slide along the path defined by the guide means. Located above the manner means 86 is a bracket means 106 which is fixedly secured to the head portion means 20 of the machine by any suitable means such as 105. Threadably secured in the bracket means 106 is an adjustable screw means 111. Depending from the screw means and formed as an integral part therewith is a pin means 113. A resilient member means 107 which may be in the form of a compression spring is disposed about the pin means 113 along the longitudinal axis of member means 86 between the lower end of screw means 111 and the top side portion means 109 of bracket means 86. The spring means is provided for normally urging member means toward the work support means 16. The screw means 111 is adjustable so that it may be positioned adequately to compensate for the variation in retardant forces, i.e., frictional forces, which are inherent with the member means.

As may be best seen in FIGS. 3 and 5, the lower end of the member means 86 is provided with a U-shaped leaf spring means 110 which serves to connect the member means 86 with the button orientating means 40. The leaf spring means includes a first portion means 112 which is securely fixed to the lower end of the member means 86 through a plurality of fastener means 114. The leaf spring means 110 is further provided with a cured central portion means 116 which serves to connect the first portion means 112 with a second portion means 118 which extends substantially parallel to the first portion means 112. The second portion means 118 of the leaf spring is preferably formed with an open slot means 120 which is formed to accommodate or straddle the grooved portion means 48 on the orientating pin bushing means 42 whereby operatively connecting the two elements. The slot means 120 open generally in all the vibratory directions of the movement of the work supporting and clamping means 26. That is, because the member means 86 is only movable in a vertical direction, while the clamping means 26 and the button orientating means 40 carried thereby are movable in a plurality of directions, the slot means 120 is provided whereby enabling freedom of movement of the orientating means in any horizontal plane while the vertical movement of the button orientating assembly means 40 is controlled by the lifting mechanism means 80. The provision of the leaf spring means 110 forms a resilient member for lifting and for yielding the button orientating means 40 when necessary.

OPERATION OF THE MACHINE

During a stitching cycle, the pin means 50 depending from the button orientating means 40 may properly orientate a button prior to sewing. As mentioned above, when the clamping assembly means 26 is in the lower position, the roller means 77, employed for lifting the clamping means 26 away from the work support means 16, is in a spaced relationship with the hook shaped rod means 78. When the button clamp lifting lever means 70 is rotated, at the completion of the sewing cycle as was described above, the actuator means 82 which is angularly responsive to movement of the lever means 70, is also forcibly rotated in an upward direction. The movement of the actuator means 82 in an upward direction causes the second end means 92 thereof to engage and cause motion to be delivered to the freely rotatable coupling or lever means 84. The motion imparted to the lever means 84 causes the same to rotate counterclockwise about its articulate connection means 94 while the second end means 96 of the lever means 84 engages the lower end means 100 of the projecting mounting means 98 on member means 86 whereby forcibly moving it upward along the path guided by the guide means 104 and the slot means 102. However, it should be noted that all of this motion occurs prior to the time that the roller means 77 contacts the undersurface of the hook shaped rod means 78, that is, all of this motion occurs prior to the time that the clamping means 26 is moved. The lifting motion imparted to the member means 86 by the actuator means 82 lifts the button orientating means 40 from its operative position shown in FIG. 1 and shiftably moves the same to its inoperative position shown in FIG. 3 whereby removing the pin means 50 from the button, as well as removing the button orientating means 40 and more particularly the depending pin means 50 from the top surface area 54 of the turret means 31 prior to the time the clamp is lifted. As may be best seen in FIG. 3, once the roller means 77 contacts the undersurface of the hook shaped rod means 78 the button orientating means 40 is raised to its uppermost position in relation to turret 31 and the entire assemblage travels upwardly along with the clamping means 26 thus assuring that the orientating pin means 50 will be positively removed from the button turret area and thus the indexing of the button turret means 31, which as described in U.S. Pat. No. 3,960,094, occurs once the button clamp means 26 has attained its uppermost position, is free to move and the depending pin means 50 are safely removed and disengaged from same.

The purpose of the spring means 107 which is disposed between the bracket means 106 and the upper surface 109 of the member means 86 will now be described. At the onset of the sewing cycle, the button clamp lifting lever means 70 is rotated in a clockwise direction (FIG. 3) thereby lowering the clamping means 26. As described above, the actuator means 82 is angularly responsive to movements of the button clamp lifting lever means 70 thus, when the lever means 70 is rotated the actuator means 82 is moved therewith. In view of the fact that there is no upwardly driving force being placed upon lever means 84 the latter is free to turn about its articulate connection means 94. Once the driving connection, that is the actuator means 82 and the lever means 84, is removed from the member means 86 there is no longer a force moving the latter in an upward direction, thus the member means 86 is free to move downwardly under its own weight in the direction of the slot means 102. As with any mechanism, there may be some frictional engagement between the slot means 102 and the guide means 104. Thus the spring means 107 having adjustable characteristics as described above acts against the upper surface 109 of the member means 86 forcibly moving member means 86 downwardly overcoming any frictional forces inherent therewith. Once the clamping means is moved into its sewing position, the spring means 107 aids in forcing the pin means 50 into the buttons. As mentioned above, at the onset of the sewing cycle the pin means 50 will normally engage a web portion in the button and not fall into the proper holes. Therefore, during rotation of the button orientating means, the spring 107 aids in slightly forcing the orientating means and more particularly the pins are aligned with the holes in the button, they will fall thereinto. This is made possible because prior to the pins falling or locating in the button holes the orientating means 40 and more particularly the cap means 46 will ride against the upper portion of the U-shaped leaf spring means and the spring will apply a slightly downward force thereto such that when the orientating means is rotated and the pin means 50 engage the button holes, the spring 107 will forcibly drive the pins 50 thereinto thus assuring a correct positioning of the button.

The advantages of such a lifting mechanism should be apparent over the prior art. That is, it should be apparent that there has been provided a lifting mechanism which is independently operated from the movement of the clamping means 26 and thus providing a positive lift for the button orientating means. By providing a lifting mechanism which is separate from the movement of the clamping means 26, the spring back effect of the button clamp does not effect the orientating mechanism because of the positive lifting mechanism being completely separate from the clamping means. It should also be apparent that the present invention would have advantages over a spring being disposed between the orientating means and the button clamp. As previously discussed, with an embodiment of the sort employing a spring for holding the button orientating means in a removed position a resonance of the orientating means could occur thus the pins would not be sufficiently removed from the area of the button turret which results at times causing jamming and damage of the turret. Since the present invention lifts the button orientating means 40 and more particularly the pin means 50 depending therefrom prior to movement of the button clamp and then together therewith, a safe removal of the pins from the top surface area of the turret may be assured.

Thus it is apparent that there has been provided, in accordance with the invention, a button orientating lifting mechanism that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A cyclically operated sewing machine having a work support means, a clamp means mounted for movement toward or away from said work support means, lever means operable in timed relation to the sewing cycle to move said clamp means away from said support means, means secured to said clamp means for delivering articles to and removing them from the sewing station including orientating means vertically movable with respect to said delivery and removal means wherein the improvement comprises:

member means connectable to said orientating means and carried by said sewing machine for vertical sliding movement relative thereto; and actuator means secured to said lever means and angularly responsive to movement thereof and operative to effect movement of said member means for effecting placement of said orientating means in timed relation to the sewing cycle.

2. The cyclic sewing machine of claim 1 wherein said member means is slideably mounted above said orientating means, said member means further including mounting means having guide means comprising means defining a slot, and a plurality of securing means passing through said slot such that said member means is constrained to move along a path defined by said guide means.

3. In a cyclic button sewing machine having a work support means, a vibratory clamp means movable towards or away from said support means, lever means operable to move said clamp means away from said work support means, means secured to said clamp means for delivering buttons to and removing them from the sewing station including orientating means operative during the sewing cycle to orientate a button for sewing, wherein the improvement comprises:

actuator means secured to said lever means and angularly responsive to movement thereof;

member means connectable to said orientating means, including mounting means for slideably supporting said member means relative to the sewing machine; and coupling means operatively engaged with said actuator means and said member means, said coupling means being operative upon movement of said actuator means to move said member means whereby rendering said orientating means inoperative upon completion of a sewing cycle.

4. The cyclic button sewing machine of claim 3 wherein said member means includes means for engaging a portion of said orientating means, said engaging means having opening means, opening generally in the vibratory directions of movement of said clamp means.

5. The cyclic button sewing machine of claim 3 wherein the lengthwise axis of said member means extends substantially perpendicular to said work support means.

6. The cyclic button sewing machine of claim 3 wherein said mounting means includes a block means formed with a guide pin embracing slot means extending along the lengthwise axis of said member means for guiding same.

7. The cyclic button sewing machine of claim 3 wherein said member means includes a leaf spring means having substantially parallel first and second portion means joined by a curved central portion means, means for attaching the first portion means to said member means, and means for operably connecting the orientating means to the second portion means of said leaf spring means.

8. The cyclic button sewing machine of claim 3 wherein said coupling means comprises a link means having a first portion means pivotally secured to said sewing machine, a second portion means engaging said mounting means and a center portion means connecting said first and second portion means, said center section being operable to associate with said actuator means.

9. The cyclic button sewing machine of claim 3 further including a bracket means secured to said sewing machine, and a resilient member means disposed between said bracket means and said member means for normally urging said member means toward said work support means.

10. The cyclic button sewing machine of claim 9 further including means adjustable secured to said bracket means for adjusting the resilient member means to such a position that it compensates for retarding forces inherent with said member means.

11. A cyclically operated sewing machine having a work support means, a clamp means, positive operating means for moving the clamp means away from the work support means, means secured to said clamp means for delivering articles to and removing them from the sewing station including orientating means shiftable between an operative and inoperative position, wherein the improvement comprises;

a member means slideably mounted upon said sewing machine and connected to said orientating means;

actuator means connected to said positive operating means and angularly responsive to movements thereof; and means responsive to movement of said actuator means for causing said member means to move said orientating means from said operative position to said inoperative position.

12. A cyclically operated sewing machine having a work support means, a vibratory button clamp means movable toward and away from said work support means, positive operating means for moving the clamp means away from the work support means, means secured to said button clamp means for delivering articles to and removing them from the sewing station including orientating means shiftable between operative and inoperative positions, wherein the improvement comprises:

an axially slideably mounted member means connected to said orientating means at one end thereof;

spring means for urging said member means in one direction and operative to move said orientating means into its operative position; and means responsive to operation of said positive operating means for moving said orientating means in a direction opposed to the direction in which said orientating means is urged by said spring means whereby rendering said orientating means inoperative upon completion of a sewing cycle.

* * * * *